United States Patent [19]

Moller

[11] 3,987,867

[45] Oct. 26, 1976

[54] SPARK ARRESTING MUFFLER FOR ENGINES

[75] Inventor: Paul S. Moller, Dixon, Calif.

[73] Assignee: Discojet Corporation, Davis, Calif.

[22] Filed: Mar. 26, 1975

[21] Appl. No.: 562,023

[52] U.S. Cl. ..... 181/56; 181/60; 181/46; 181/59

[51] Int. Cl.[2] ..... F01N 1/08

[58] Field of Search ..... 181/360, 346, 56, 60, 181/69; 55/276

[56] References Cited

UNITED STATES PATENTS

| | | | |
|---|---|---|---|
| 734,749 | 7/1903 | Rauch | 181/60 |
| 951,770 | 3/1910 | Miller | 181/60 |
| 1,266,255 | 5/1918 | Harris | 181/69 |
| 3,677,364 | 7/1972 | Pawlina | 181/360 |
| 3,687,225 | 8/1972 | Nelson | 181/360 |
| 3,779,342 | 12/1973 | Broberg | 181/56 |
| 3,880,252 | 4/1975 | Mucka | 181/46 |
| 3,884,655 | 5/1975 | Coop | 181/360 |

FOREIGN PATENTS OR APPLICATIONS

| | | | |
|---|---|---|---|
| 207,663 | 12/1923 | United Kingdom | 181/60 |

*Primary Examiner*—L. T. Hix
*Assistant Examiner*—Vit W. Miska
*Attorney, Agent, or Firm*—Lothrop & West

[57] ABSTRACT

A spark arresting muffler has a housing with an inlet designed for attachment to the exhaust pipe of an engine. A packet of discs is mounted on the housing preferably in line with the inlet. The discs are substantially identical and are preferably circular or annular in plan and are cupped in side elevation. The discs are axially spaced from each other by edge projections on one disc abutting the adjacent disc, the projections conveniently being deformations integral with the discs. A spark receiver is disposed in communication with the disc packet to receive and hold sparks rejected by the packet.

1 Claim, 8 Drawing Figures

SPARK ARRESTING MUFFLER FOR ENGINES

It is becoming increasingly necessary to provide substantial muffling of internal combustion engines in order to reduce objectionable noise without increased back pressure on the engine. In some special cases; for example, for forestry service, it is also necessary to provide a spark arresting muffler capable of catching and retaining sparks of carbon and the like discharged by the engine and which might otherwise escape to the surroundings as a fire hazard.

An object of the invention is to provide a muffler and spark arrester fulfilling the foregoing conditions.

Another object of the invention is to provide a muffler that is light in weight, compact in volume, effective to muffle sounds and to arrest sparks, and economical to manufacture.

A further object of the invention is to provide a muffler in which there is a substantial heat dissipating surface so that the temperature of operation of the muffler, even under heavy duty, remains at a feasible level so that the muffler has a protracted life.

Another object of the invention is to provide a muffler which can, with little difficulty, be assembled in different fashions in order to vary its effectiveness under different operating conditions.

Another object of the invention is in general to provide an improved muffler and spark arrester.

Other objects, together with the foregoing, are attained in the embodiments of the invention described in the accompanying description and illustrated in the accompanying drawings, in which.

The muffler pursuant to the invention has been successfully incorporated in several forms particularly for use with internal combustion engines employed to propel vehicles such as automobiles and motorcycles especially those utilized in the forest. There is an important requirement for quite good sound dissipation, particularly sounds of annoying frequencies. There is also a virtual necessity to have a muffler that does not become over heated and is effective to trap and retain carbon or other incandescent particles that are a severe fire hazard.

Figure 1:
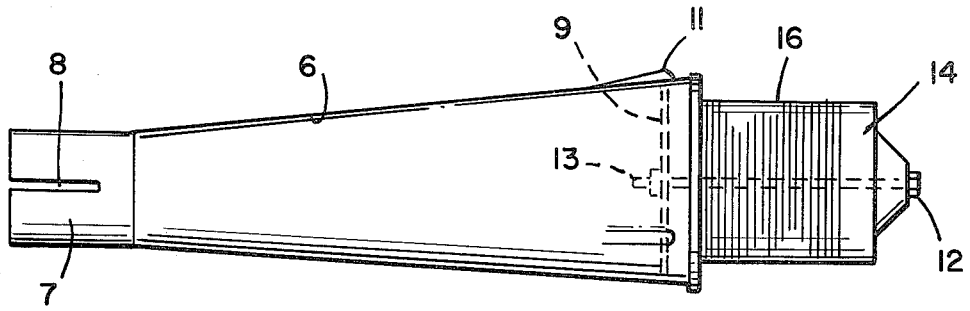
FIG. 1 is a side elevation of one form of spark arrester muffler constructed pursuant to the invention.

In one of the arrangements, especially as shown in FIG. 1, there is provided a housing 6 conveniently fabricated of relatively stiff metal sheet or the like secured into a flaring conical form and generally empty. At one, smaller end the conical housing 6 merges with a cylindrical portion 7 having a slot 8 therein. The portion 7 serves as an inlet to the housing and is engaged with the exhaust pipe of an engine (not shown) and is clamped in supported and communicating position thereon.

At the opposite end of the housing 6 there is afforded a spider 9 having legs entering into and confined in pockets 11 formed in the material of the cone. The spider serves as a connection for a through bolt 12 having a securing nut 13 thereon. The bolt is in immediate abutment with a spark arresting chamber 14. The bolt 12 also holds in clamped position between the end of the muffler housing 6 and the arrester housing 14 a packet 16 of individual plates or discs, as particularly shown in FIGS. 2 and 3. The packet is a stack or group of a number of substantially identical separate and individual members. A representative disc 17 is preferably formed of a sheet of metal which is generally flat and has a generally circular opening 18 in the center thereof. Around its edges or periphery the disc is provided with spacers 19 in the form of integral deformations of the sheet to constitute lugs and to abut against the neighboring similar disc and to hold the neighboring discs a predetermined axial distance apart.

When the discs 17 are assembled into a packet 16 and the bolt 12 is tightened, the packet then forms a partial enclosure with spaces 21 or channels between the individual discs; such spaces serving as conduits for the exhaust gas from the muffler chamber 6 to escape through. The gas enters through the aligned, central openings 18 and then travels radially outwardly having an increasing area of path to follow. Thus pressure of the gas tends to increase as it moves radially outwardly. Finally, the gas leaves the periphery of the packet and, in the form shown in FIG. 1, enters the atmosphere. The division of the initial gas stream into a number of different streamlets, each of which goes in a disc-like space 21 or channel, causes the sound waves to be substantially attenuated and the gases to be substantially cooled.

Figure 2:
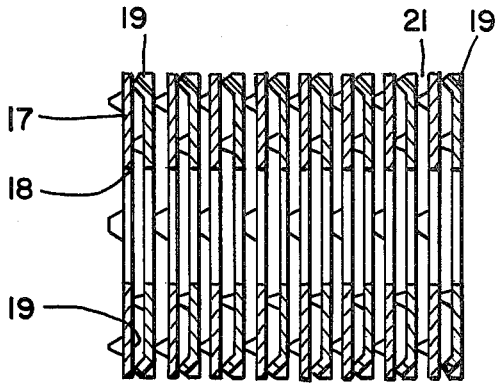
FIG. 2 is a cross-section on a longitudinally extending or axial plane through a packet of discs utilized in connection with the muffler of FIG. 1.
Figure 3:
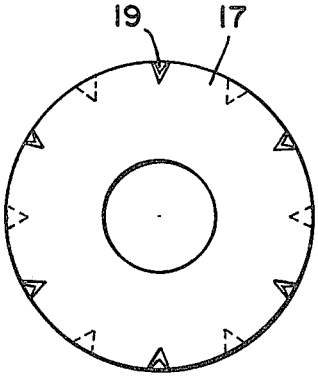
FIG. 3 is an end elevation of a disc in a form suitable for use in the packet of FIG. 2.

With an arrangement as shown in FIGS. 1, 2 and 3, for example, any hot particles such as sparks in the exhaust gas which do not deposit during the drop in flow velocity within the chamber 6, travel generally in an axial direction through the central passageway 18. If they are of a size too great to pass through the channels 21 they are retained generally within the packet. But any sparks that have sufficient velocity to pass through the entire packet enter into the receiving chamber 14 wherein they lose their velocity and deposit and are held by gravity.

Figure 4:
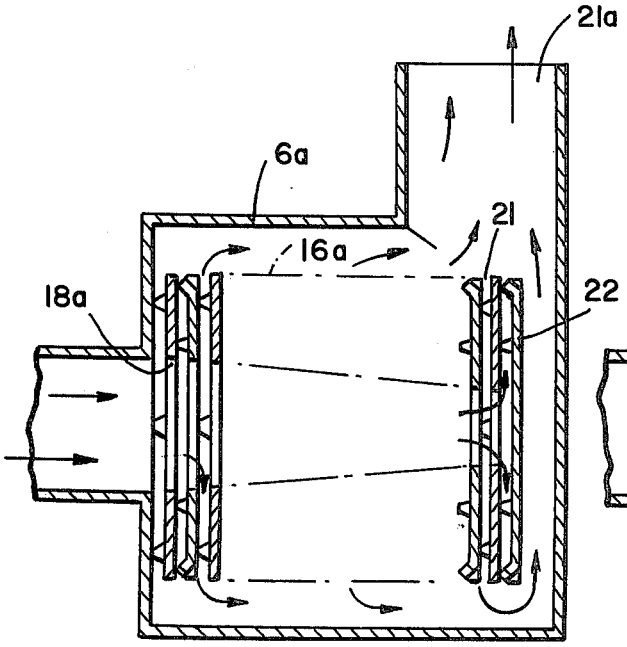
FIG. 4 is a cross-section on a longitudinal plane showing a muffler of a slightly different configuration.

In the FIG. 1 version, although the packet is supported on the muffler housing, it is not itself encased. In FIG. 4 the packet 16*a*, similarly constructed, is held within a housing 6*a* having an outlet 21*a* to the atmosphere. In this instance, the central openings 18*a* decrease gradually in diameter from a large size near the inlet to a much smaller size toward the outlet. The end disc 22 is imperforate so that the entering gases dissipate in a radial direction and exit through the outlet 21*a*. Particles of carbon which are relatively small and harmless can go through the passageways between the discs. Many fall to the bottom of the housing for gravital retention.

Figure 5:
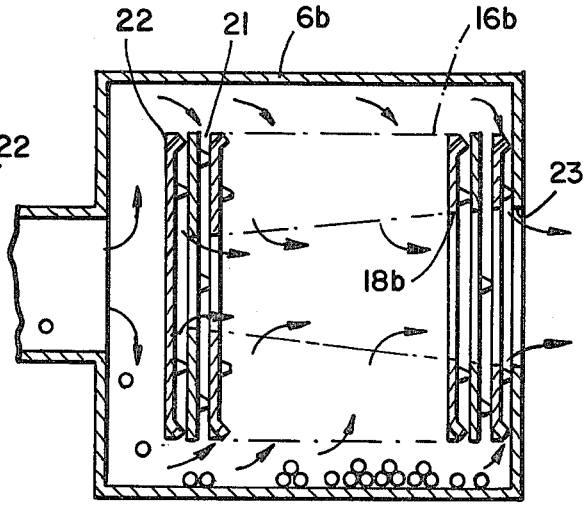
FIG. 5 is a view of a further modified form of muffler roughly comparable to that in FIG. 4.

In the instance shown in FIG. 5, the arrangement is like that of FIG. 4. The packet 16*b*, however, has a blank disc 22 at the inlet end, and the central openings 18*b* in the successive discs gradually increase in diameter from near the inlet end to the opposite end. While in FIG. 4 the gas flow is from the central portion of the discs radially outwardly, in the FIG. 5 version the flow is first into the housing 6*b* and then radially inwardly between the discs to the generally conical interior passage, from which the gases escape through an opening 23 in the end wall of the housing. In this instance, particularly adapted for heavy carbon or spark content, there is an immediate diversion of high velocity sparks to the outside or bottom of the housing, wherein the sparks tend to be retained by gravity. Only those that are small enough to pass between the discs, and therefore are not harmful, are permitted into the central portion of the packet, from which they escape with the gases.

Figure 6:
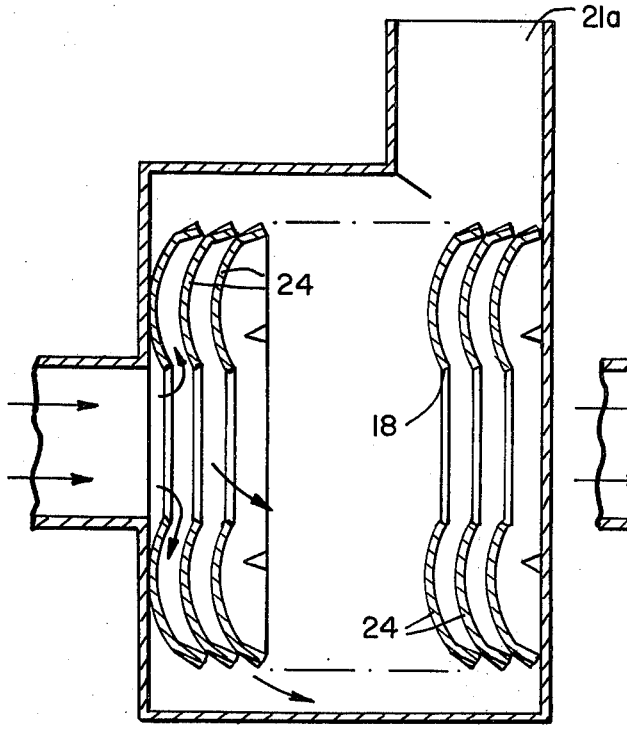
FIG. 6 is a view like FIG. 4 but showing discs of cupped configuration in a muffler housing.

In an arrangement as shown in FIG. 6, the structure is similar to that of FIG. 4 except that the discs 24 are particularly configured. Each of them is a portion of a toroid or is annular in plan and is cupped in side elevation. The discs 24 are stacked in a packet as before and are held by spot welds or the like. They are preferably arranged so that the inlet gases must partially turn back on themselves in order to flow out through the approximately radial but curved passages between the successive discs.

Figure 7:
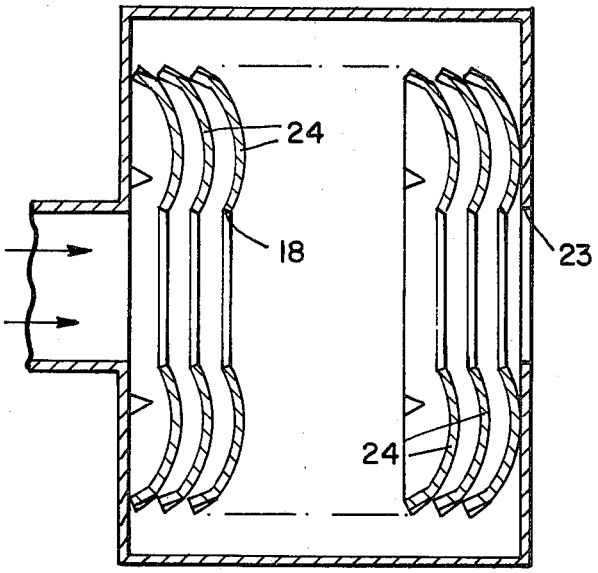
FIG. 7 is a view comparable to FIG. 5 but showing discs cupped in side elevation.

Similar discs are utilized in the version shown in FIG. 7. In this instance, the position of the disc packet is reversed. There is an easy curved path for the incoming gases to flow generally radially out between the assembled discs and to escape axially through an end opening. The general characteristics of the FIG. 7 version are like those of FIG. 6 except that the reflections from the differently positioned discs are different. With careful design, the disc packet is arranged so that there is a negative back pressure on the exhaust. Engine operation is not only not hampered but is actually enhanced.

Figure 8:
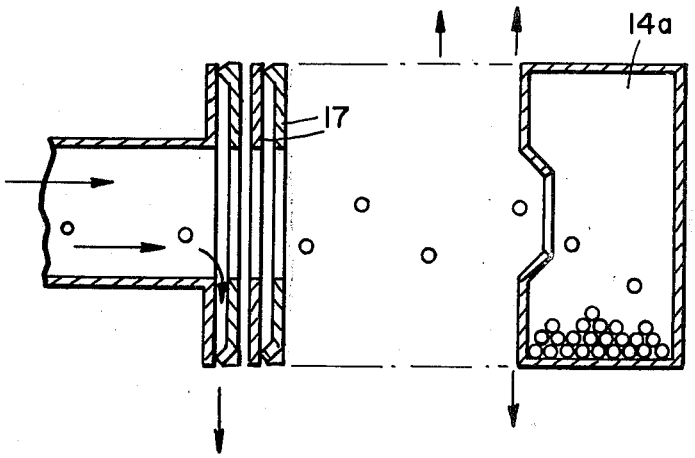
FIG. 8 is an arrangement of the muffler and disc packet with a special, axial compartment for spark reception and retention.

In an arrangement as shown in FIG. 8, the device is substantially the same as in FIG. 1. In this instance, however, the spark trap 14*a* is of different configuration and is held to the remaining part of the packet by spot welds (not shown) or the like rather than by a through bolt 12. In this instance as well, the exhaust gas is radially dissipated and is cooled on its way to the atmosphere. The sound waves are reflected and attenuated so that they are unobjectionable when discharged. Axially traveling hot, heavy particles or sparks travel between the edges of the discs in the central portion of the packet and enter into the spark chamber 14*a* wherein they lose their energy and deposit.

What is claimed is:

1. A spark arresting muffler for engines comprising a housing symmetrical about an axis and having an axial opening at one end thereof, a packet including a plurality of identical discs, each disc having a central opening therethrough, lugs on said discs constituted by integral axially directed edge deformations of said discs spaced apart around the periphery thereof and abutting adjacent discs in said packet and spacing said discs apart, an otherwise closed chamber having an axial opening, means for holding said packet with said discs in registry with each other along said axis and with all of said lugs disposed in the same axial direction and with one end of said packet against said end of said housing with the openings in said discs all in axial alignment with said housing opening and for holding said chamber against the other end of said packet with said axial chamber opening against and in axial communication with said openings in said discs for receiving and holding sparks from said housing opening rejected by said packet.

* * * * *